United States Patent [19]

Ando et al.

[11] 4,256,204

[45] Mar. 17, 1981

[54] SAFETY APPARATUS FOR ELEVATOR SYSTEM

[75] Inventors: Takeki Ando, Ibaraki; Seiya Shima; Toshiaki Kurosawa, both of Katsuta; Hiromi Inaba, Hitachi; Hiroaki Kuroha; Hideo Miyao, both of Katsuta; Yoshio Sakai, Ibaraki; Katuhito Issiki, Katsuta, all of Japan

[73] Assignee: Hitachi, Ltd., Japan

[21] Appl. No.: 938,347

[22] Filed: Aug. 31, 1978

[30] Foreign Application Priority Data

Sep. 2, 1977 [JP] Japan ..... 52/104891

[51] Int. Cl.[3] ..... B66B 5/02

[52] U.S. Cl. ..... 187/29 R

[58] Field of Search ..... 187/29

[56] References Cited

U.S. PATENT DOCUMENTS

| | | | |
|---|---|---|---|
| 1,148,450 | 7/1915 | Fuller | 187/29 |
| 3,961,688 | 6/1976 | Maynard | 187/29 |
| 4,101,007 | 7/1978 | Magee | 187/29 |

*Primary Examiner*—J. V. Truhe
*Assistant Examiner*—W. E. Duncanson, Jr.
*Attorney, Agent, or Firm*—Craig and Antonelli

[57] ABSTRACT

A safety apparatus for an elevator system is disclosed in which upon detection an instantaneous power service interruption, an emergency brake is applied to the car and continues to be applied for longer than the time required for the particular car to stop.

7 Claims, 9 Drawing Figures

SAFETY APPARATUS FOR ELEVATOR SYSTEM

BACKGROUND OF THE INVENTION

1. Field of the Invention

This invention relates to an improvement in a safety apparatus for an elevator system, or more in particular to a safety apparatus capable of overcoming an instantaneous power service interruption which is expected to be restored naturally.

2. Description of the Prior Art

When an abnormal condition occurs while an elevator car is running, the condition is detected and the car is stopped by emergency braking, and kept stationary so as to enable the maintenance personnel to check for the abnormal condition until the recovery of the abnormal condition is attained. A typical means for detecting the abnormal condition is a governor switch for detecting the overspeeding of the car. When this switch is actuated by the detection of the overspeed, the detected condition is mechanically held by a mechanical holding means.

The elevator car, however, is required to be braked in various abnormal situations irrelevant to such mechanical holding means or is naturally braked upon occurrence of certain types of abnormality.

Such a problem is an instantaneous power failure or service interruption wherein a power supply voltage instantaneously drops to zero or a low level and then restores to a normal level.

Generally, an elevator system is supplied with electric power from a substation in the building in which the elevator system is installed (hereinafter referred to as the building substation), which electric power in turn is supplied from an external substation. The other various loads in the building are also supplied with power from the building substation in similar fashion. In the event that an accident occurs in the transmission line, the external substation or the building substation, a power failure may occur even while the elevator car is running. In almost all large buildings, however, power is supplied through double feeder systems and therefore a comparatively short, instantaneous service interruption rather than a prolonged power failure is likely to occur. With buildings rising even higher, elevator car speeds are being increased. Thus in the case of a comparatively short service interruption for an elevator running at a high-speed, it sometimes happens that power is restored and thrown in again before the elevator car comes to a complete stop. In this case, the elevator car to which an emergency brake is already applied due to the power failure will then regain normal operation due to the immediate power restoration only to endanger the passengers by a sudden change of speed from a deceleration to an acceleration.

An especially serious problem is encountered when one of the many relays used in the elevator control system is deenergized for a short period of time by the drop of the source voltage, even if power failure does not occur. If that particular relay has an important function in the elevator operation, the normal elevator operation is interrupted for a short length of time thereby resulting in a sudden change of speed from a deceleration to an acceleration.

The undesirable deenergization of the relay is attributable to various causes including a fault in the relay itself or in the control circuit, the instantaneous drop of the elevator source voltage to the level sufficient to deenergize a particular relay or an instantaneous service interruption.

If the deenergized relay has a function to store information on the direction of movement of the elevator car, on the other hand, the elevator car instantaneously loses the command of movement direction upon the deenergization of the relay and may come to receive a command of the same direction or the reverse direction upon the recovery of power. More specifically, assume that a relay storing the information of "up" direction is actuated and the elevator car is running upward around the seventh floor in response to a tenth-floor call while a fifth-floor call is also present. Under this condition, if the relay storing the "up" direction is deenergized by an abnormality attributable to some cause, the fact that a fifth-floor call has been generated may cause actuation of another relay storing the "down" direction upon the recovery of power. The elevator will then try to turn its direction abruptly, and the resulting sudden change in acceleration will deliver a very great stock both to the passengers and the car, leading to a serious accident.

One of the operating requirements of the elevator car is that the door of the car is completely closed. The door of a running elevator car may be opened instantaneously by mischief or other causes. In this case, too, the elevator car may be subjected to emergency braking and subsequently restore normal operation, so that the speed of the car changes suddenly from a deceleration to an acceleration thereby exposing the passengers to a great danger.

SUMMARY OF THE INVENTION

An object of the present invention is to provide a safety apparatus for the elevator system, which protects the passengers from an instantaneous power service interruption.

According to the present invention, there is provided a safety apparatus for the elevator system, comprising trouble detector means for detecting a problem and being energized upon the detection of the problem and restored to an inoperative state when the problem is eliminated, emergency brake means for applying the brake to an elevator motion system, and means for holding the emergency brake means in an operative condition in response to the operation of the problem detector means until the elevator motion system stops.

DESCRIPTION OF THE PREFERRED EMBODIMENTS

Figure 1:
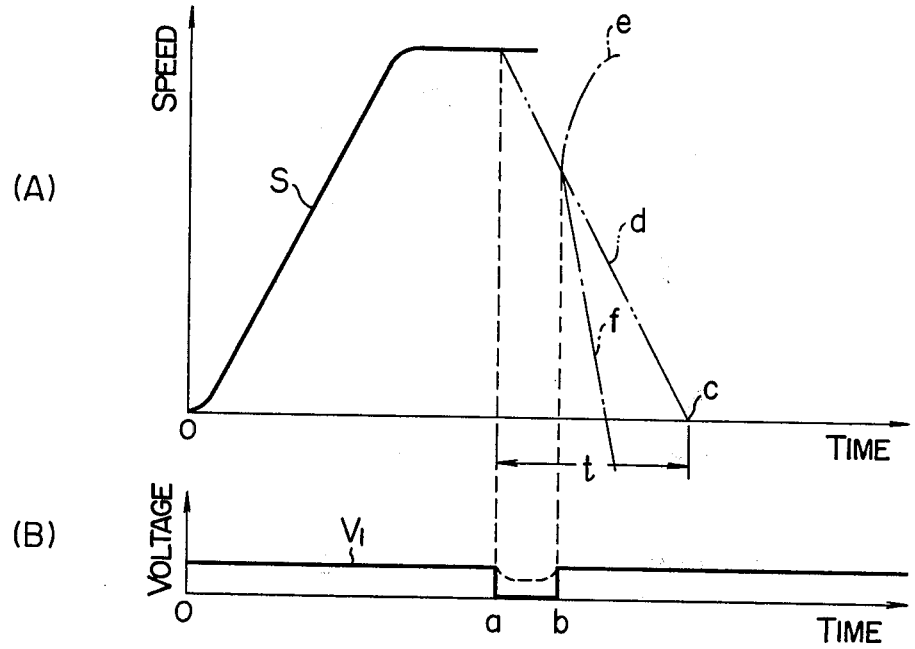
FIG. 1 is a diagram for explaining an elevator car phenomenon when a problem occurs.

With reference to FIG. 1, explanation will be made below of the case in which a given relay in the elevator control system is abnormally deenergized when it should be kept energized.

In (A) of FIG. 1, it is assumed that the elevator car starts at time point O, is accelerated at substantially a constant rate, and thereafter runs at constant speed, as shown by the speed curve S. In (B) of FIG. 1, the source voltage $V_1$ is shown by the solid line including the period of time from point a to b where the elevator power supply is interrupted. During the same period, the dashed line shows a drop in the source voltage $V_1$ to such a degree as to deenergize a given relay.

If a given relay is deenergized and the car starts to run by inertia at time point a, the car shows various movements depending on the load condition thereof. It is assumed here that the car is decelerated in such a case.

If the elevator power supply is interrupted at a time point a, the car is decelerated along the straight line d until it stops at a time point c. In the case where the car is running at high-speed, the time t from the point a to the stoppage is so long that service interruption sufficiently short to be restored before the car stops (hereinafter referred to as the instantaneous service interruption) may occur. During such an instantaneous service interruption, all the relays in operation are not deenergized but some of them are kept energized. When power is restored under such a condition, the car subsequently shows various movements depending on the states of the relays. If the relay for providing a command for moving the elevator in the same direction as it was moving is energized, the car's speed will be increased again as shown by the curve e. If the relay for providing a command for moving the elevator in the direction reverse to that in which it was previously moving is energized, by contrast, the car will decelerate as shown by curve f and then run in the opposite direction.

A similar phenomenon as shown by the curve e may occur when the door of the car is instantaneously opened and closed for some reason while it is running. Such a phenomen is likely to expose the passengers to danger and damage the elevator system.

Figure 2:
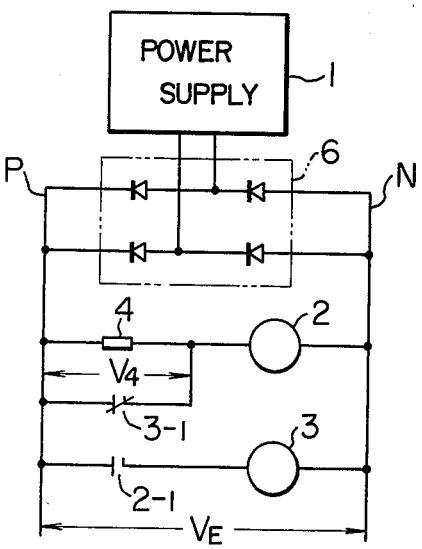
FIG. 2 shows a diagram of a service interruption detector circuit according to an embodiment of the present invention.

A service interruption detector circuit according to the present invention is shown in FIG. 2, in which the voltage of the elevator power supply 1 is rectified by the rectifier 6 and converted into DC power supplies P and N. The resistor 4 is connected in parallel to the break contact 3-1 of the service interruption detection auxiliary relay 3. An end of the parallel circuit is connected to the positive potential point P, and the other end thereof to an end of the service interruption detection relay 2. The other end of the service interruption detection relay 2 is connected to the negative potential point N. One end of the service interruption detection auxiliary relay 3 is connected via the make contact 2-1 to the power supply P and the other end thereof is connected to the power supply N.

In this configuration, assume that the elevator power supply 1 is thrown in and, after that, a service interruption occurs. When the elevator power supply 1 is thrown in, the service interruption detection relay 2 is connected between the positive potential point P and the negative potential point N through the break contact 3-1. Also, the service interruption auxiliary relay 3 is energized through the make contact 2-1 of the service interruption detection relay 2. As a result, the break contact 3-1 of the service interruption detection auxiliary relay 3 is opened, and thus the service interruption detection relay 2 is connected to the power supply through the resistor 4.

When the elevator power supply 1 is stopped, the power service interruption detection relay 2 is deenergized at highest voltage and speed, at a voltage higher; than the the deenergization voltage of any other relays used for elevator control.

Figure 3:
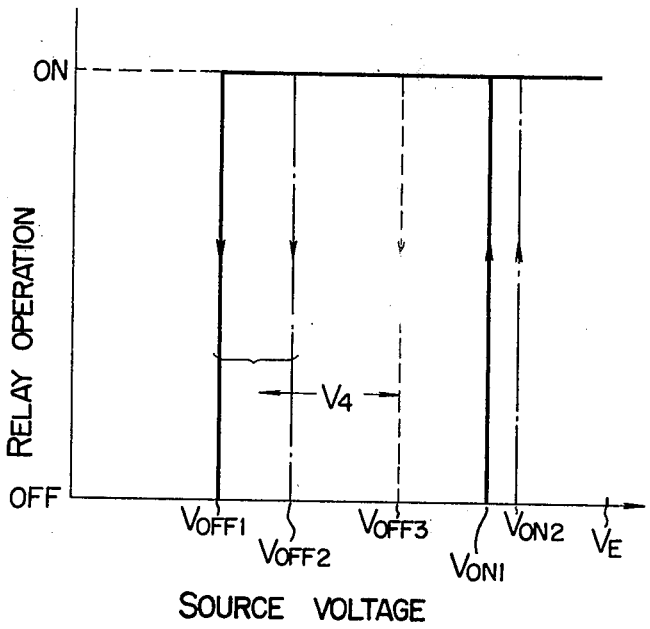
FIG. 3 is a diagram for explaining the operation of a relay.

In other words, the service interruption detection relay 2 has the characteristics as shown in FIG. 3. The drawing under consideration also includes the energizing and deenergizing voltage characteristics of other various types of relays used for the elevator system. As compared with the elevator source voltage $V_E$, the energizing voltage (the voltage of the power supply 1 enough to energize a relay) varies from $V_{ON1}$ to $V_{ON2}$ and the deenergizing voltage (the voltage of the power supply 1 enough to deenergize a relay) from $V_{OFF1}$ to $V_{OFF2}$ depending on the type of relay involved. The service interruption detection relay 2, on the other hand, has such a characteristic that it is deenergized at a higher voltage $V_{OFF3}$ and earlier than the other relays used. Specifically, the relay 2 is deenergized at a voltage higher than the other relays by the voltage $V_4$ across the resistor 4 in FIG. 2.

Figure 4:
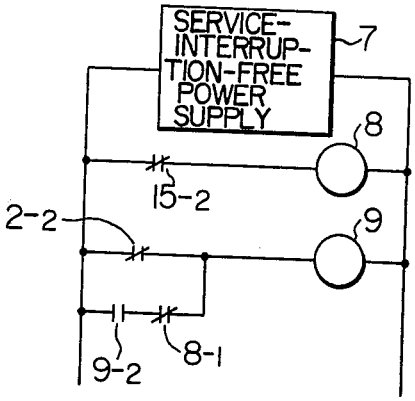
FIG. 4 is a diagram showing a service interruption control circuit according to an embodiment of the present invention.

The diagram of FIG. 4 shows the service interruption control circuit in which the service-interruption-free power supply 7 such as a battery is connected to the timing device 8 through the break contact 15-2 of an emergency relay described later. The break contact 2-2 of the service interruption relay 2 is connected in parallel to a series circuit including the make contact 9-2 of the service interruption control relay 9 and the break contact 8-1 of the timing device 8. The service interruption control relay 9 is connected via this parallel circuit to the power supply. Explanation will be made, with reference to FIG. 5, about the case in which a service interruption occurs while the elevator car is running. Assume that the car starts at a time point O, is accelerated at substantially the same rate, runs at steady speed, and the elevator power supply 1 fails at the point a. In FIG. 2, the service interruption detection relay 2 is deenergized first, and the contact 2—2 in FIG. 4 is closed. As a result, the service interruption relay 9 is energized, thus forming a holding circuit by the make contact 9-2, the brake contact 8-1 and the relay 9.

Figure 6:
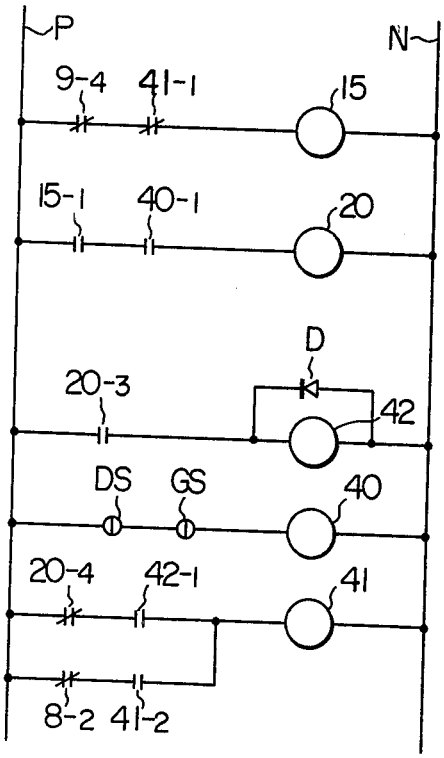
FIG. 6 is a diagram showing an emergency stop circuit according to an embodiment of the present invention.

By the energization of the service interruption control relay 9, on the other hand, the emergency relay 15 of the emergency stop circuit of FIG. 6 is deenergized in response to the opening of the service interruption control relay contact 9-4.

Upon deenergization of the emergency relay 15, the contact 15-1 of the emergency relay is opened, thereby deenergizing the operating relay 20. The deenergization of the emergency relay 15 also causes a power supply for other relays to be cut off.

Figure 7:
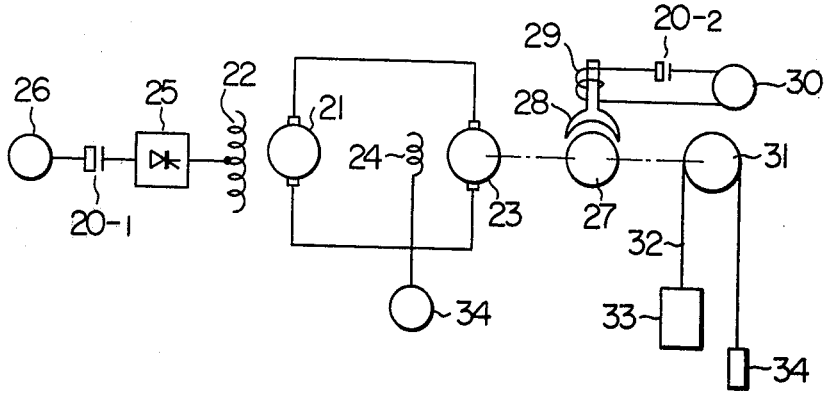
FIG. 7 is a diagram showing the elevator main circuit according to the embodiment of FIG. 6.

In response to the deenergization of the operating relay 20, the contacts 20-1 and 20-2 of the operating relay 20 are opened in the elevator main circuit shown in FIG. 7.

When the contact 20-1 of the operating relay is opened, the speed command device 26 is separated from the generator control device 25, so that the generator field control device 25 controls the field 22 of the generator 21 in such a manner as to decelerate and stop the motor 23.

In response to the opening of the contact 20-2 of the operating relay 20, on the other hand, the brake coil 29 is separated from the power supply 30. The brake shoe 28 is pressed against the brake drum 27 directly coupled to the motor 23, thus generating the braking force. The sheave 31 directly connected with the brake drum 27 is stopped, so that the passenger cage 33 and the balance weight 34 directly connected to the ends of the rope 32 are stopped.

Incidentally, reference numeral 24 shows the field winding of the motor 23, which is excited by the constant current source 34.

As a result of deenergization of the emergency relay 15, the contact 15-2 in FIG. 4 is closed, thus energizing the timing device 8. After a predetermined time period of energization, the timing device 8 opens the break contact 8-1. Before the contact 8-1 is opened, therefore, the service interruption control relay 9 is kept energized. Thus, the contact 9-4 in FIG. 6 is maintained open and the emergency relay 15 is kept deenergized. In the meantime, the operating relay 20 is not energized, thereby keeping the condition of emergency stop. In this way, the elevator car can be stopped surely by setting the operation timing of the timing device 8 at the time T longer than the time t required for the car running at the highest speed to come to a stop in case of emergency.

Figure 5:
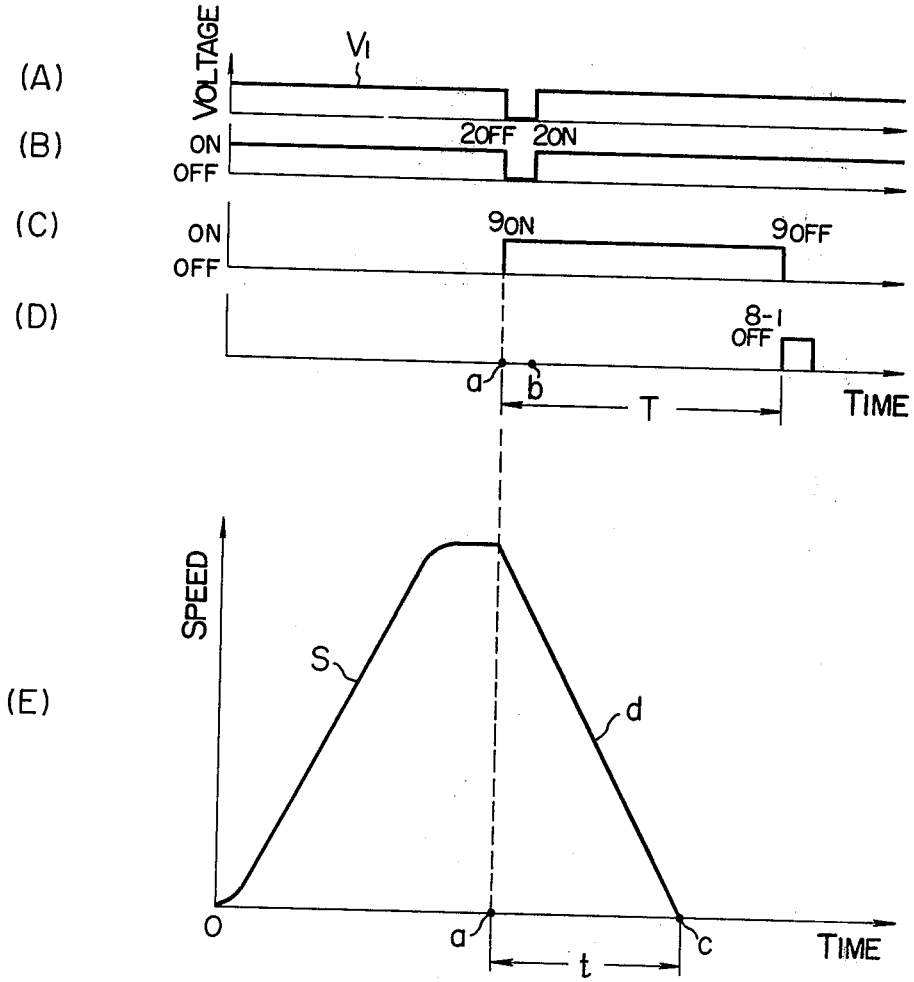
FIG. 5 is a diagram for explaining an elevator car phenomenon according to the present invention in case of a problem occurring.

In (A) of FIG. 5, assume that an instantaneous service interruption occurs in which the voltage $V_1$ of the power supply 1 disappears for the period between points a and b. The service interruption relay 2 is deenergized for the period from a to b as shown in (B) of FIG. 5. As shown in (C) of FIG. 5, however, the service interruption control relay 9 energized at point a is kept energized after the power restoration at point b and deenergized only by the opening of the contact 8-1 of the timing device shown in (D) of FIG. 5. As a result, the elevator car is kept subjected to the emergency stop operation until the time point c at which the car is positively stopped after being subjected to emergency braking along the speed curve d shown in (E) of FIG. 5, as described above. This eliminates the inconvenience met by the conventional system, in which the restart circuit is actuated before the elevator car stops, thereby securing the safety of the passengers and protecting the equipment.

After the stoppage of the car, the service interruption control relay 9 is deenergized and therefore the elevator car is restored to an operable condition for continued service.

Figure 8:
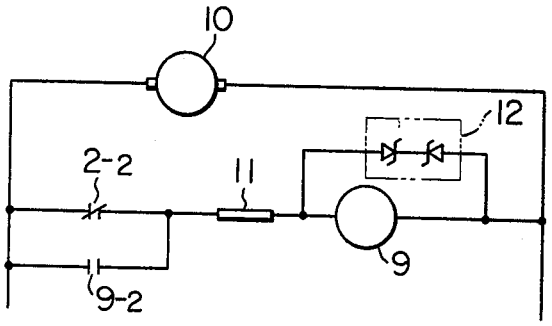
FIG. 8 is a diagram showing a service interruption control circuit according to another embodiment of the present invention.

The diagram of FIG. 8 shows another embodiment of the service interruption control circuit similar to that shown in FIG. 4. An end of the tachogenerator 10 directly coupled to the elevator drive motor 23 or like is connected to an end of a parallel circuit including the break contact 2-2 of the service interruption detection relay 2 and the make contact 9-2 of the service interruption control relay 9. The other end of the parallel circuit is connected to one end of a resistor 11, the other end of which is connected to an end of a parallel circuit of the service interruption control relay 9 and the contact voltage diode 12. The other end of the parallel circuit including the service interruption control relay 9 and the constant voltage diode 12 is connected to the other end of the tachogenerator 10.

This configuration makes it possible to determine, in the case of service interruption, whether the car is running or stopped.

In other words, if a service interruption occurs while the car is running, the contact 2—2 of the service interruption detection relay connects the service interruption control relay 9 to the tachogenerator 10. In view of the fact that the car is running, a voltage is generated across the tachogenerator 10 so that the service interruption control relay 9 is energized and holds the energizing state thereof. Until the voltage generated across the tachogenerator 10 becomes substantially zero, the service interruption control relay 9 is kept energized. When the voltage generated across the tachogenerator 10 becomes zero, i.e., when the elevator car has completely come to a stop, the service interruption control relay 9 is deenergized thereby to release the emergency stop condition. As long as the service interruption control relay 9 is energized, the emergency stop circuit is driven and the elevator car is subjected to emergency stop in the same manner as in the above-mentioned case.

The constant voltage diode 12 is for preventing the voltage across the service interruption control relay 9 from increasing to an excessively high level on the one hand and for monitoring the elevator car until it substantially comes to a stop on the other hand. The resistor 11 has a function to protect the constant voltage diode 12 and so on.

By configuring the service interruption control circuit in this way, the stoppage of the elevator car is directly detected and therefore the release of the emergency stop condition can be synchronized with the stoppage of the elevator car, thus shortening the elevator car down time to a minimum.

Figure 9:
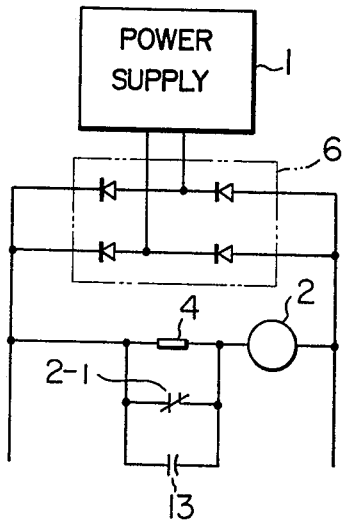
FIG. 9 is a diagram showing a service interruption detector circuit according to another embodiment of the present invention.

Another embodiment of the service interruption detector circuit similar to that shown in FIG. 2 is illustrated in FIG. 9, in which like numerals denote like component elements in FIG. 2.

In this embodiment, the service interruption detection relay 2 is supplied with a power and energized upon the throwing-in of the power supply 1. Upon the energization of the relay 2, the break contact 2-1 is opened thereby connecting the relay 2 to the resistor 4 in series, so that the relay 2 is deenergized by a voltage of the power supply 1 much lower than that in case of connecting the relay 2 directly across the power supply. Thus the relay 2 is deenergized by a little decrease of the voltage of the power supply.

In this case, the relay 2 may repeat on-off operations intermittently when the source voltage is low. To eliminate this inconvenience, the capacitor 13 is connected in parallel with the resistor 4 thereby stabilizing the operation of the relay 2. This construction eliminates the need for the auxiliary relay 3 (FIG. 2), resulting in lower cost.

As explained above, at the time of an instantaneous service interruption, the service interruption control circuit of service-interruption-free type shown in FIG. 4 or 8 serves as a memory, so that the emergency stop condition is positively held until the elevator comes to a complete stop.

Next, explanation will be made of the problem in which the door of the car is opened momentarily and closed at the next instant.

If the door switch DS or gate switch GS in FIG. 6 is opened while the car is running, the door relay 40 is deenergized. Upon deenergization of the door relay 40, the make contact 40-1 thereof opens, thereby deenergizing the operating relay 20. The contacts 20-1 and 20-2 of the operating relay shown in FIG. 7 are opened in response to the deenergization of the operating relay 20, thus starting the emergency stop operation as mentioned above. The contact 20-3 of the operating relay 20 is also opened, thus deenergizing the running relay 42. The deenergization of the running relay 42 is delayed for a time period during which the electromagnetic energy of the running relay 42 is circulated through the diode D and disappears. Within this delay time, the open door detection relay 41 is energized via the running relay contact 42-1 in response to the closing of the running relay contact 20-4, while at the same time the energization of the relay 41 is held by the make contact 41-2 of the open door detection relay 41 and the brake contact 8-2 of the timing relay 8. The opening, if any, of the door of a running car is thus detected, and the contact 41-1 of the open door operated relay is opened, thereby deenergizing the emergency relay 15. In response to the deenergization of the emergency relay 15, the emergency relay contact 15-2 is closed and the operation of the timing device 8 started as shown in FIG. 4. The timing device 8 is set at a length longer than the time required for the elevator car running at the highest speed to come to a complete stop.

Thus after the emergency relay 15 is deenergized and the elevator car comes to a complete stop, the timing device 8 is actuated. The contact 8-2 of the timing device 8 opens, the holding circuit 8-2, 41-2 of the open door detection relay 41 is cut off, and the open door detection relay 41 is deenergized. Only after that is the emergency relay 15 energized again.

Even if the door switch DS or gate switch GS is closed and the door relay 40 is energized so that the contact 40-1 is closed again before the elevator car comes to a stop, the operating relay 20 fails to be energized and the emergency stop condition is positively maintained until the elevator car comes to a complete stop in view of the fact that the contact 15-1 is open.

In this manner, the elevator car comes to an emergency stop in the case where the door of a running car opens. Further, the emergency stop condition is maintained for a predetermined period of time, thus preventing the sudden change in acceleration or deceleration of the car. The safety of both passengers and the equipment is thus secured.

Further, the power supplies P and N of the emergency stop circuit in FIG. 6 may of course be configured in the same manner as the power supplies P and N of the service interruption detection circuit of FIG. 2.

The means for applying the emergency brake to the elevator car (the brake for other than that used for normal deceleration) may take the form of electric braking to the elevator driving motor instead of the mechanical brake means such as an electromagnetic brake.

Furthermore, the present invention is of course applicable to an AC elevator system using an induction motor as a driving source.

We claim:

1. A safety apparatus for an elevator system, comprising:

a power supply;

a motor supplied with power by said power supply;

a sheave driven by said motor;

an elevator car operated by the rotation of said sheave;

an electromagnetic brake capable of holding the elevator motion system of said motor, said sheave and said car in a stop condition;

an elevator control device to which power is supplied from said power supply;

voltage drop responsive means being operated in response to the voltage drop of said power supply to a predetermined voltage which is higher than the deenergization voltage of any of the relays included in said elevator control device and lower than the normal voltage of said power supply, said voltage drop responsive means being restored to a nonoperation state in response to the recovery of said power supply to the normal voltage thereof;

emergency brake means for applying an emergency brake to said elevator motion system; and holding means responsive to the operation of said voltage drop responsive means for maintaining said emergency brake means in an operated condition until said elevator motion system comes to a stop.

2. A safety apparatus for the elevator system according to claim 1, in which said holding means includes means for detecting the elevator car speed, and means for deenergizing said emergency brake means in response to the reduction in the output of said speed detector means.

3. A safety apparatus for the elevator system according to claim 1, in which said voltage drop responsive means includes means for detecting the interruption of service of said power supply.

4. A safety apparatus for the elevator system according to claim 1, in which said voltage drop responsive means includes means for detecting that the door of the car running is not completely closed.

5. A safety apparatus for the elevator system according to claim 1, in which said holding means includes a timer set in response to the operation of said voltage drop responsive means at a time lapse longer than the time required for the elevator motion system to stop by the energization of said emergency brake means after the energization of said emergency brake means.

6. A safety apparatus for the elevator system according to claim 1, in which said holding means includes memory means responsive to the operation of said voltage drop responsive means, means for clearing the storage of said memory means after stoppage of said elevator motion system, and means for actuating said emergency brake means in response to the output of said memory means.

7. A safety apparatus for the elevator system according to claim 1, in which said voltage drop responsive means includes a relay connected to said power supply through an impedance element which is connected in series with said relay with respect to said power supply.

* * * * *